US007686945B2

(12) United States Patent
Benard et al.

(10) Patent No.: US 7,686,945 B2
(45) Date of Patent: Mar. 30, 2010

(54) PROCESS TO PREPARE WATER-WHITE LUBRICANT BASE OIL

(75) Inventors: Gerard Benard, Petit Courone (FR); Patrick Moureaux, Petit Courone (FR)

(73) Assignee: Shell Oil Company, Houston, TX (US)

( * ) Notice: Subject to any disclaimer, the term of this patent is extended or adjusted under 35 U.S.C. 154(b) by 838 days.

(21) Appl. No.: 10/333,419

(22) PCT Filed: Jul. 10, 2001

(86) PCT No.: PCT/EP01/07933

§ 371 (c)(1),
(2), (4) Date: Jan. 17, 2003

(87) PCT Pub. No.: WO02/06427

PCT Pub. Date: Jan. 24, 2002

(65) Prior Publication Data

US 2003/0149318 A1 Aug. 7, 2003

(30) Foreign Application Priority Data

Jul. 17, 2000 (EP) ..... 00402037

(51) Int. Cl.
*C10G 49/06* (2006.01)

(52) U.S. Cl. ..... 208/114; 208/58; 208/60; 208/138; 208/89; 208/118; 208/97; 208/111.35; 208/211; 208/212; 208/213

(58) Field of Classification Search ..... 208/58, 208/60, 138, 89, 114, 118, 97, 111
See application file for complete search history.

(56) References Cited

U.S. PATENT DOCUMENTS

| | | | | | |
|---|---|---|---|---|---|
| 4,795,546 | A | | 1/1989 | Miller | |
| 5,554,307 | A | * | 9/1996 | Dagorn et al. | 508/111 |
| 5,935,416 | A | | 8/1999 | Cody et al. | |
| 5,993,644 | A | * | 11/1999 | Xiao et al. | 208/89 |
| 6,051,127 | A | * | 4/2000 | Moureaux | 208/58 |
| 6,103,101 | A | * | 8/2000 | Fragelli et al. | 208/89 |

FOREIGN PATENT DOCUMENTS

| | | | |
|---|---|---|---|
| EP | 0 712 922 A2 | | 5/1996 |
| EP | 0 712 922 A3 | | 5/1996 |
| EP | 0 536 325 B1 | | 9/1999 |
| GB | 1333826 | | 10/1973 |
| GB | 1381004 | | 1/1975 |
| WO | 98/02502 | | 1/1998 |
| WO | WO 98/01515 | * | 1/1998 |
| WO | 00/29511 | | 5/2000 |

* cited by examiner

*Primary Examiner*—Tam M Nguyen
(74) *Attorney, Agent, or Firm*—Charles W. Stewart

(57) ABSTRACT

Process to prepare a water-white lubricating base oil having a saturates content of more than 90 wt %, a sulphur content of less than 0.03 wt % and a viscosity index of between 80-120 by subjecting a non-water-white hydrocarbon feed having a lower saturates content than the desired saturates content to a hydrogenation step, the hydrogenation step comprising contacting the feed with hydrogen in the presence of a hydrogenation catalyst, wherein the contacting is performed in two steps: (a) contacting the hydrocarbon feed with hydrogen in the presence of a hydrogenation catalyst at a temperature of above 300° C. and at a WSHV of between 0.3 and 2 kg of oil per litre of catalyst per hour, and (b) contacting the intermediate product obtained in step (a) with hydrogen in the presence of a hydrogenation catalyst at a temperature of below 280° C.

7 Claims, No Drawings

PROCESS TO PREPARE WATER-WHITE LUBRICANT BASE OIL

FIELD OF THE INVENTION

The invention relates to a process to prepare a water-white lubricating base oil having a saturates content of more than 90 wt %, a sulphur content of less than 0.03 wt % and a viscosity index (VI) of between 80-120 by subjecting a non-water-white hydrocarbon feed having a lower saturates content than the desired saturates content to a hydrogenation step. In a hydrogenation step the main reaction is the hydrogenation of aromatic compounds and any other unsaturated compound to saturate compounds.

BACKGROUND OF THE INVENTION

Lubricating base oils having the above properties are sometimes referred to as a API Group II base oils as defined in API Publication 1509: Engine Oil Licensing and Certification System, "Appendix E-API Base Oil Interchangeability Guidelines for Passenger Car Motor Oil and Diesel Engine Oils". These properties are also mentioned in Oil & Gas Journal, Sep. 1, 1997, pages 63-70.

In the above referred to Oil & Gas Journal article various routes to Group-II base oils are described. All of the possible routes will involve at one point a hydrogenation of the aromatics and other unsaturated compounds to obtain a base oil having the desired saturates content. Such a hydrogenation will typically be performed by contacting the feed with hydrogen in the presence of a hydrogenation catalyst, typically a Group VIII metal supported catalyst.

U.S. Pat. No. 5,935,416 describes a process to prepare API Group II base oils, wherein the above to referred hydrogenation step is performed as a so-called cold (mild) hydrofinishing step at a temperature of between 230 and 300° C. The disclosed catalyst used in the hydrofinishing step is a catalyst containing Group VIB metals and a non-noble Group VIII metal.

WO-A-9802502 discloses a process to prepare API Group II base oils, wherein the hydrogenation process step is performed using a hydrogenation catalyst comprising a platinum/palladium alloy. The illustrated reaction temperature of the hydrogenation was 232° C.

GB-A-1381004 discloses a process to prepare a base oil by contacting a feed with a nickel-tungsten on alumina catalyst at temperature of between 360 and 410° C. and subsequently contacting the effluent of said step with a catalyst comprising a crystalline aluminosilicate faujasite and palladium at a temperature of between 230 and 370° C. According to this publication hydrogenation and desulphurisation takes place in the first step and conversion of polycyclic naphthenes and isomerisation of paraffins takes place in the second step. This second step cannot be considered to be a hydrogenation step in view of the conversion reactions taking place in this step as catalysed by the crystalline aluminosilicate faujasite.

GB-A-1333826 discloses a hydrogenation step in a process to prepare base oils. In Example 1 of this publication a three-stage hydrogenation process is illustrated using a nickel on Kieselguhr catalyst, wherein the reaction temperature was 221° C. in the first stage, 232° C. in the second stage and 260° C. in the third stage. The increased severity of the hydrogenation conditions was necessary, according to this publication, to improve the colour.

Applicants have found it almost impossible to prepare in a practical manner water-white Group II base oils, especially having a saturates content of more than 95 wt % and up to 99 wt %, and especially starting from the more difficult feeds containing higher sulphur and/or nitrogen levels using conventional methods. Either colored Group II base oils or water-white products having a saturates content of less than 90 wt % were prepared. With a practical manner is here meant a process having an acceptable capacity and/or having an acceptable reactor volume.

Water-white base oils are desirable because, for example, it ensures the absence of heavy polyaromatics and other harmful species which are detrimental to the product quality, such as for example the oxidation stability. The colour is suitably expressed by means of Colour Saybolt. Preferably the base oil has a Colour Saybolt of above 20 and more preferably above 25. The method of determining Colour Saybolt is described in ASTM D-156 method.

SUMMARY OF THE INVENTION

It is the object of the present invention to provide a hydrogenation process wherein a water-white base oil having the desired properties can be obtained.

This object is achieved with the following process.

Process to prepare a water-white lubricating base oil having a saturates content of more than 90 wt %, a sulphur content of less than 0.03 wt % and a viscosity index of between 80-120 by subjecting a non-water-white hydrocarbon feed having a lower saturates content than the desired saturates content to a hydrogenation step, the hydrogenation step comprising contacting the feed with hydrogen in the presence of a hydrogenation catalyst, wherein the contacting is performed in two steps:

(a) contacting the hydrocarbon feed with hydrogen in the presence of a hydrogenation catalyst at a temperature of above 300° C. and at a WSHV of between 0.3 and 2 kg of oil per litre of catalyst per hour, and (b) contacting the intermediate product obtained in step (a) with hydrogen in the presence of a hydrogenation catalyst at a temperature of below 280° C.

It has been found that with the hydrogenation process according to the invention water-white lubricating base oils can be prepared having a high saturates content.

DETAILED DESCRIPTION OF THE INVENTION

The hydrocarbon feed which is used in step (a) may be obtained from various sources. A most common source of the hydrocarbon feed to be used in step (a) is a hydrocarbon feed which in turn is obtained starting from a vacuum distillate or a de-asphalted vacuum residue. These vacuum distillates are obtained by first distilling a petroleum crude feedstock at atmospheric conditions wherein a residue is obtained, which residue is subsequently distilled at reduced pressure obtaining vacuum distillates and a vacuum residue. From the vacuum residue, asphalts are removed in a de-asphalting unit, thereby obtaining a de-asphalted vacuum residue. Part of the aromatics are removed from the vacuum distillate or de-asphalted vacuum residue by means of solvent extraction. In an optional subsequent step, wax is removed from the solvent extracted product to obtain the hydrocarbon feed which can be used in step (a). Typically the wax is removed by solvent dewaxing. Optionally wax is removed by means of catalytic dewaxing or isodewaxing.

Optionally the solvent refined product as described above is first subjected to a combined hydrodesulphurisation (HDS) and/or hydrodenitrogenation (HDN) step before being used as hydrocarbon feed of step (a). This is advantageous when the solvent refined intermediate product contains high levels of sulphur and/or nitrogen.

The feed of step (a) may also be prepared by processes starting from a vacuum distillate or de-asphalted vacuum residue involving a hydrodesulphurisation (HDS) and/or hydrodenitrogenation (HDN) step followed by a hydrocracking step and optionally a catalytic dewaxing or isodewaxing step as known to one skilled in the art.

Another source of the hydrocarbon feed to step (a) is the product obtained by catalytic dewaxing or isodewaxing a feed containing a high fraction, preferably more than 50 wt %, of wax. Examples of such waxy feeds are slack wax and synthetic waxes as obtained in a Fischer-Tropsch process. Another example of a waxy feed is the high boiling fraction of a hydrocracker process, which process primarily prepares lower boiling middle distillates. Examples of a suitable catalytic dewaxing or isodewaxing processes are described in WO-A-200029511 and EP-A-536325.

The product obtained in the hydrogenation process according to the present invention can be further treated, for example in a clay treating process or contacting with active carbon, as for example described in U.S. Pat. No. 4,795,546 and EP-A-712922, in order to improve the stability of the base oil.

If wax is still present in the feed to step (a) a dewaxing step may be performed on the product of the process according to the invention in order to meet any pour point specification. This dewaxing process may be a solvent dewaxing process or catalytic dewaxing or isodewaxing process as known to one skilled in the art.

It has been found that the hydrogenation process according the present invention is particularly suitable when preparing the desired base oils starting from the more difficult feeds, sometimes referred to as refractory feeds, which feeds are characterised by a relatively high sulphur, nitrogen and/or aromatics content and/or a darkish colour. Especially when preparing base oils having a very high saturates content of more than 95 wt %, more especially more than 98 wt %, it has been found that when starting from these more difficult feeds water-white base oils were difficult to prepare with the state of the art processes.

The aromatics content of the feed to step (a) can be between 10% and 65 wt %. The more difficult feed may contain between 35-65 wt % aromatics. The sulphur content can be above 0.03 wt % to even values up to and exceeding 3 wt %. The nitrogen content can be above 1000 ppmw to even values up to and exceeding 2000 ppmw. Suitably the sulphur content is lower than 0.03 wt % and more preferably lower than 1000 ppmw sulphur. Suitably the nitrogen content will be lower than 100 ppmw and more preferably lower than 50 ppmw nitrogen.

The colour of the feed to step (a) will be non-white. The invention is especially advantageous when starting from very coloured hydrocarbon feeds to step (a). The colour of the feed will then be such that it cannot be expressed anymore by means of Saybolt Colour. When expressed in terms of "ASTM colour" as described in ASTM D-1500 method, the colour of such a feed is higher than 0.5. The more difficult feed will have a colour of more than 3 and especially 4 or above.

The hydrogenation catalyst is suitably a supported catalyst comprising a dispersed Group VIII metal. Possible Group VIII metals are cobalt, nickel, palladium and platinum. Cobalt and nickel containing catalysts may also comprise a Group VIB metal, suitably molybdenum and tungsten.

Suitable carrier or support materials are amorphous refractory oxides. Examples of suitable amorphous refractory oxides include inorganic oxides, such as alumina, silica, titania, zirconia, boria, silica-alumina, fluorided alumina, fluorided silica-alumina and mixtures of two or more of these.

Suitable hydrogenation catalysts include those catalysts comprising as one or more of nickel (Ni) and cobalt (Co) in an amount of from 1 to 25 percent by weight (% wt), preferably 2 to 15% wt, calculated as element relative to total weight of catalyst and as the Group VIB metal component one or more of in an amount of from 5 to 30% wt, preferably 10 to 25% wt, calculated as element relative to total weight of catalyst. Examples of suitable nickel-molybdenum containing catalyst are KF-847 and KF-8010 (AKZO Nobel) M-8-24 and M-8-25 (BASF), and C-424, DN-190, HDS-3 and HDS-4 (Criterion). Examples of suitable nickel-tungsten containing catalysts are NI-4342 and NI-4352 (Engelhard), C-454 (Criterion). Examples of suitable cobalt-molybdenum containing catalysts are KF-330 (AKZO-Nobel), HDS-22 (Criterion) and HPC-601 (Engelhard).

Suitable hydrogenation catalysts have a good hydrogenation performance and are less sensitive for sulphur and/or nitrogen which may be present in the feed. When processing sulphur free feeds a pure nickel containing catalyst might be used. For hydrocracked feeds, especially containing a low amount of sulphur of between 50 and 1000 ppmw, preferably platinum containing and more preferably platinum and palladium containing catalysts are used in steps (a) and optionally in step (b). Especially suitable when processing the above referred to non-white feeds, which may contain high levels of sulphur and/or nitrogen, such as for example the refractory feeds as described above, are the platinum/palladium containing catalysts. More preferably such catalysts are used in both step (a) and step (b). The catalyst of step (a) and (b) are preferably the same. The total amount of these noble Group VIII metal component(s) present on the catalyst is suitably from 0.1 to 10% wt, preferably 0.2 to 5% wt, which weight percentage indicates the amount of metal (calculated as element) relative to total weight of catalyst.

Preferred supports for these palladium and/or platinum containing catalysts are amorphous silica-alumina, whereby more preferably the silica-alumina comprises from 2 to 75% wt of alumina. Examples of suitable silica-alumina carriers are disclosed in WO-A-9410263 which is hereby incorporated by reference. A preferred catalyst comprises an alloy of palladium and platinum preferably supported on an amorphous silica-alumina carrier of which the commercially available catalyst C-624 of Criterion Catalyst Company (Houston, Tex.) is an example. These catalysts are advantageous because they deactivate less when the sulphur content of the feed is relatively high.

Step (a) is performed at a temperature of above 300° C. In this step the main part of the hydrogenation of the aromatic compounds takes place, in particular the hydrogenation of mono-aromatics. The temperature will suitably not exceed 400° C. and preferably is in the range of from between 300° C. and 380° C. The operating hydrogen pressure may range from 10 to 250 bar. It has been found that improved results are obtained at higher pressures, preferably above 100 bar and more preferably between 120 and 250 bar. The WHSV (Weight hourly space velocity) ranges from 0.3 to 2 kg of oil per liter of catalyst per hour (kg/l.h). The actual operating conditions will depend on the required degree of saturation and the aromatics content in the feed and can be easily determined by one skilled in the art given the above guidelines.

Step (b) is performed at a temperature of below 280° C. and more preferably below 250° C. In this step the colour improvement takes place. The minimum temperature is suitably above 100° C. The operating hydrogen pressure may range from 10 to 250 bar. It has been found that improved results with respect to colour are obtained at higher pressures, preferably above 100 bar and more preferably between 120 and 250 bar. The WHSV preferably ranges from 0.3 to 3 kg of oil per litre of catalyst per hour (kg/l.h) and more preferably between 1 and 1.5 kg/l.h. The actual operating conditions will depend on the required colour and the colour of the feed and can be easily determined by one skilled in the art given the above guidelines.

Step (a) and step (b) are preferably performed at the same hydrogen partial pressure for practical reasons. The hydrogenation catalyst is preferably present in a packed bed reactor. Step (a) and Step (b) can be performed in a continues operation in two separate sequentially arranged reactors, suitably with means to cool the intermediate product before it is used in step (b). Suitable cooling means are indirect heat exchangers, for example tube/shell heat exchangers. It is also possible to perform step (a) and (b) in one and the same reactor in a so-called blocked out operation, wherein first the feed is fed to the reactor under the conditions of step (a) and second the collected intermediate product is fed to the same reactor under the conditions of step (b). The latter procedure is advantageous with respect to the number of required hydrogenation reactors when a two step hydrogenation according to the invention is only occasionally required.

Optionally, for example when the required temperature difference between steps (a) and (b) is not too big, step (a) and step (b) can be performed in a stacked bed column. Between the catalyst beds means to reduce the temperature, for example by means of a quench, will be present.

The invention will be illustrated by the following non-limiting examples.

Example 1

A feed having the properties as stated in Table 1 was obtained by first hydrocraking a vacuum distillate and subsequently catalytic dewaxing the hydrocracked product.

TABLE 1

| Property | Feed to step (a) |
|---|---|
| saturates (wt %) (ASTM D 2007) | 90 |
| polars (wt %) (ASTM D 2007) | 10 |
| aromatics (wt %) (ASTM D 2007) | 10 |
| sulphur (mg/kg) | 132 |
| nitrogen (mg/kg) | 2 |
| Viscosity Index | 98 |
| viscosity at 100° C. (cSt) | 8.8 |
| viscosity at 40° C. (cSt) | 2.446 |
| pour point (° C.) | −25 |
| colour ASTM | 4 |

The feed described in Table 1 was hydrogenated by contacting with a platinum/palladium catalyst of the Criterion Catalyst Company, namely the C-624 catalyst at a hydrogen partial pressure of 200 bar and a WSHV of 1 kg/l.hr at 370° C. and at a recycle gas rate of 1500 Nl/kg. The effluent of this reaction was hydrogenated under the same conditions but now at 230° C. The resultant base oil had a saturates content of 98.2 wt % and a Colour Saybolt of +28, a sulphur content of 6.6 mg/kg and a VI of 106.

Example 1 illustrates that with the process of the invention group II base oils can be prepared having a very high saturates content and an excellent colour.

Example 2

Example 1 was repeated except that the pressure was 140 bar and the temperature in the first hydrogenation step was 345° C. The resultant base oil had a saturates content of 95.6 wt % and a Colour Saybolt of +24, a sulphur content of 6.2 mg/kg and a VI of 102.

Comparative Experiment A

A feed, obtained by first hydrocracking a base oil distillate fraction and subsequently catalytic dewaxing, contained about 21 wt % aromatics. This feed was hydrogenated by contacting with a platinum/palladium catalyst of the Criterion Catalyst Company, namely the C-624 catalyst at a hydrogen partial pressure of 140 bar and a WSHV of 1 kg/l.hr and at a recycle gas rate of 1500 Nl/kg at different temperatures. See Table 2 for results at the different temperatures.

TABLE 2

| Temperature (° C.) | Colour of hydrogenated product | Aromatic content SMS 2660 (% m) |
|---|---|---|
| 220 | Colour Saybolt 23 | 16.2 |
| 250 | Colour Saybolt 20 | 14.0 |
| 280 | Colour Saybolt 15 | 11.3 |
| 310 | ASTM 1− (*) | 8.1 |

(*) colour too dark to be expressed in Colour Saybolt. Instead the colour is expressed in ASTM D-1500 method having the value 1−.

The results in Table 2 illustrate that good colour can be obtained at low temperatures. However the desired Group II base oil is not obtained because the aromatics content is too high. If the degree of hydrogenation is increased by raising the temperature the desired water-white colour is not obtained.

We claim:

1. A process to prepare a water white lubricating base oil in a blocked out operation, wherein said process comprises:

distilling a petroleum crude feedstock at atmospheric conditions to obtain a atmospheric residue;

distilling said atmospheric residue under reduced pressure conditions to obtain a vacuum distillate and a vacuum residue;

dewaxing said vacuum distillate or vacuum residue to thereby remove wax therefrom and provide a non-water white hydrocarbon feed, wherein said non-water white hydrocarbon feed has a saturates content of less than 90 wt %, an aromatics content between 10% and 65%, a sulphur content above 0.03 wt %, and an ASTM colour higher than 0.5 as determined by the ASTM D-1500 method;

contacting said non-water white hydrocarbon feed with a hydrogenation catalyst consisting essentially of a noble Group VIII metal on an amorphous refractory oxide support contained within a hydrogenation reactor and in the presence of hydrogen and under first hydrogenation conditions including at a temperature above 300° C. and at an WHSV between 0.3 and 2 kg of oil per liter of said hydrogenation catalyst per hour and yielding from said hydrogenation reactor an intermediate product having a reduced aromatic content;

separately collecting said intermediate product;

ceasing said contacting of said non-water white hydrocarbon feed with said hydrogenation catalyst within said hydrogenation reactor; and thereafter, contacting said intermediate product that has been separately collected with said hydrogenation catalyst contained within said hydrogenation reactor and in the presence of hydrogen and under second hydrogenation conditions including at a temperature below 280° C. and yielding from said hydrogenation reactor said water white lubricating base oil having a saturates content of more than 90 wt %, a sulfur content of less than 0.03 wt %, a viscosity index of between 80120, and a Colour Saybolt of above 20 as determined by the ASTM D-156 method.

2. A process as recited in claim 1, wherein said hydrogenation catalyst comprises a noble Group VIII metal and an amorphous refractory oxide support.

3. A process as recited in claim 2, wherein the saturates content of said water white lubricating base oil is more than 95 wt %.

4. A process as recited in claim 3, wherein said water white lubricating base oil has a Colour Saybolt of above 25.

5. A process as recited in claim 4, wherein said non-water white hydrocarbon feed has an aromatics content between 35% and 65%.

6. A process as recited in claim 5, wherein said non-water white hydrocarbon feed has an ASTM colour more than 3.

7. A process as recited in claim 6, wherein said non-water white hydrocarbon feed has an ASTM colour more than 4, and wherein the saturates content of said water white lubricating base oil is more than 98 wt %.

* * * * *